US011844980B2

(12) United States Patent
Brown et al.

(10) Patent No.: US 11,844,980 B2
(45) Date of Patent: Dec. 19, 2023

(54) EXERCISE DEVICE

(71) Applicant: Stealth Body Fitness, LLC, Bradenton, FL (US)

(72) Inventors: Donald Brown, Williamsport, PA (US); Howard Panes, Bradenton, FL (US)

(73) Assignee: Stealth Body Fitness, LLC, Bradenton, FL (US)

( * ) Notice: Subject to any disclaimer, the term of this patent is extended or adjusted under 35 U.S.C. 154(b) by 35 days.

(21) Appl. No.: 17/707,531

(22) Filed: Mar. 29, 2022

(65) Prior Publication Data

US 2023/0310930 A1 Oct. 5, 2023

(51) Int. Cl.
*A63B 22/16* (2006.01)
*A63B 23/02* (2006.01)

(52) U.S. Cl.
CPC ..... *A63B 23/0205* (2013.01); *A63B 22/16* (2013.01)

(58) Field of Classification Search
CPC . A63B 23/0205; A63B 23/0211; A63B 22/16; A63B 22/0056; A63B 22/18; A63B 26/00; A63B 26/003; A63B 21/068; A63B 21/4033; A63B 21/4035; A63B 21/0023
See application file for complete search history.

(56) References Cited

U.S. PATENT DOCUMENTS

| | | | | |
|---|---|---|---|---|
| 2,714,007 | A * | 7/1955 | Lightfoot | A63B 22/18 482/146 |
| 5,897,474 | A * | 4/1999 | Romero | A63B 22/14 482/79 |
| 6,945,920 | B1 * | 9/2005 | Kemery | A63B 22/16 482/146 |
| 7,175,577 | B2 * | 2/2007 | Greenspan | A61H 1/0262 482/79 |
| 9,555,275 | B1 * | 1/2017 | Izzolo, Jr. | B32B 3/14 |
| 10,265,582 | B2 * | 4/2019 | Price | A63B 23/025 |
| 10,583,321 | B2 * | 3/2020 | Panes | A63B 21/0023 |
| 2010/0087301 | A1 * | 4/2010 | Juncker | A63B 21/0004 482/146 |
| 2010/0183814 | A1 * | 7/2010 | Rios | A63B 60/00 427/387 |
| 2014/0051553 | A1 * | 2/2014 | Hetzel | A63B 21/0004 482/52 |
| 2015/0238795 | A1 * | 8/2015 | Domesick | A63B 21/0023 482/142 |

* cited by examiner

*Primary Examiner* — Loan B Jimenez
*Assistant Examiner* — Kathleen M Fisk
(74) *Attorney, Agent, or Firm* — Foley & Lardner LLP

(57) ABSTRACT

Systems and methods directed to a multi-configurable fitness device are disclosed. The device includes an upper base, a lower base, one or more wings, and a pivoting mechanism. The upper base and the one or more wings form a device holder being shaped and sized to receive an electronic device.

13 Claims, 12 Drawing Sheets

EXERCISE DEVICE

TECHNICAL FIELD

The present disclosure relates to fitness equipment, and in particular, to fitness equipment to train abdominal muscles.

BACKGROUND

Various types of exercises have been created for exercising particular muscles of the human body. For example, one relatively popular exercise for exercising the muscles of the abdomen and core is known as "planking." During such an exercise, a person places his or her body in a prone position or pushup position with legs straight or bent and toes or knees touching a support surface while supporting the upper body with the hands (pushup position) or the forearms (plank position) on a support surface. The idea is to hold the body in an erect horizontal position using the core muscles to stabilize the body. The planking exercise has been performed on a wobble board-type device. When planking on a wobble board on a floor, however, if the user tilts from side to side, the wobble board tends to slide across the floor, forcing the user to move his or her feet to stay properly aligned with the wobble board. This reduces the effectiveness of the planking exercise and increases the likelihood of injury.

SUMMARY

In some arrangements, an exercise device includes an upper base, a lower base, one or more wings, and a pivoting mechanism. The upper base and the one or more wings form a device holder being shaped and sized to receive an electronic device.

In some arrangements, a method for using an exercise device includes placing an exercise device as described herein on a surface, positioning the exercise device on the surface, placing one or more hands on the exercise device, and performing one or more exercises using the exercise device.

In some arrangements, a method for manufacturing an exercise device includes providing an upper base, providing a lower base, the lower base coupled to the upper base, providing one or more wings, at least one of the one or more wings being operatively coupled to another of the one or more wings, and providing a pivoting mechanism coupled to the lower base. The upper base and the one or more wings combine to form a device holder, the device holder being shaped and sized to receive an electronic device.

These and other features, together with the organization and manner of operation thereof, will become apparent from the following detailed description when taken in conjunction with the accompanying drawings.

BRIEF DESCRIPTION OF THE FIGURES

The details of one or more implementations are set forth in the accompanying drawings and the description below. Other features, aspects, and improvements of the disclosure will become apparent from the description, the drawings, and the claims, in which:

Figure 1:
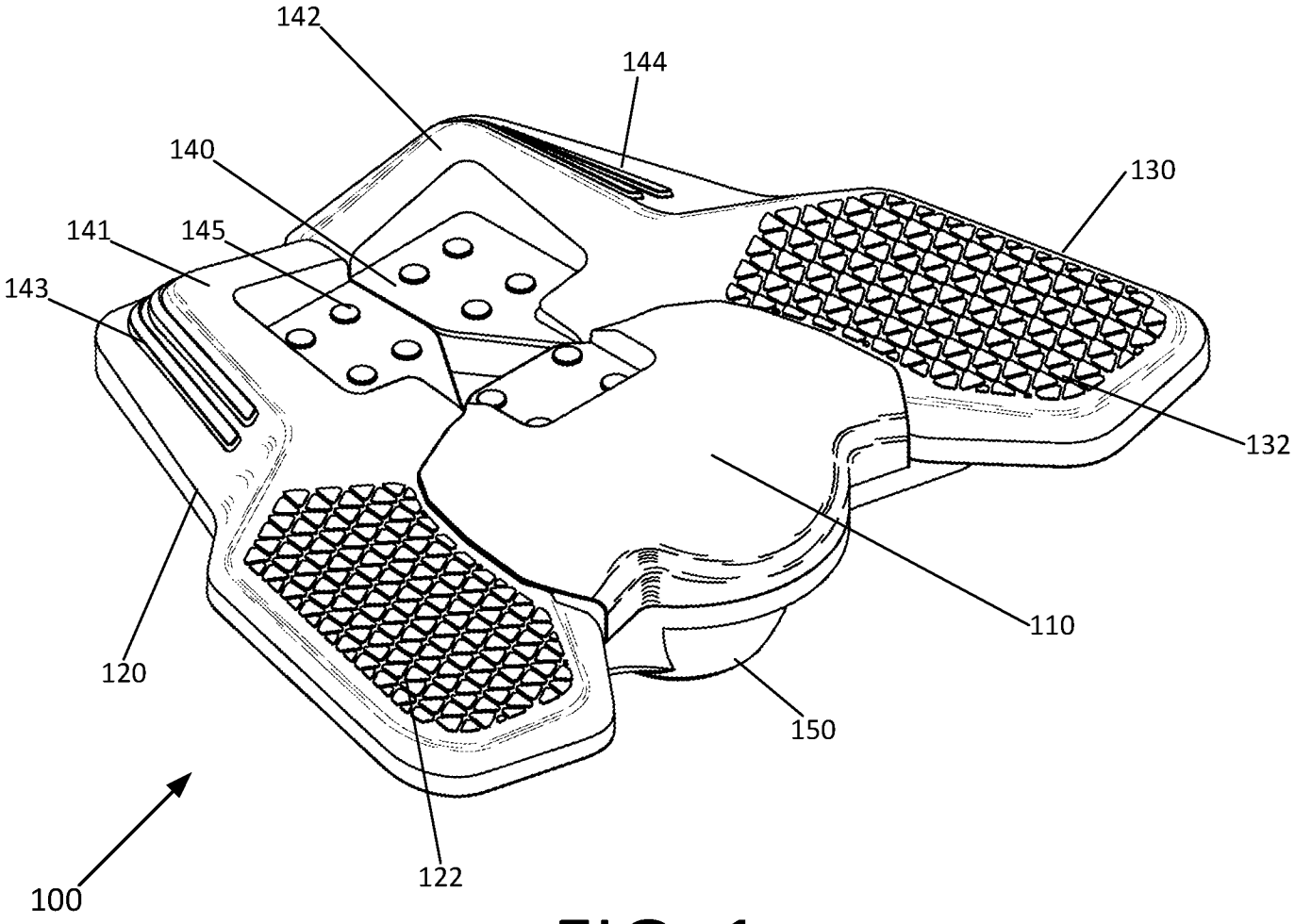
FIG. 1 is a perspective view of an assembly of a fitness device, according to some arrangements.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for a multi-configurable fitness device. The various concepts introduced above and discussed in greater detail below may be implemented in any number of ways, as the concepts described are not limited to any particular manner of implementation. Examples of specific implementations and applications are provided primarily for illustrative purposes.

Referring generally to the FIGS., the various arrangements disclosed herein relate to systems, apparatuses, and methods for an exercise device used for perform abdominal exercises, including planking exercises. More specifically, arrangements herein relate to an exercise device with removable wings and a dynamic pivoting base that allow for easy positioning of the exercise device and a secure base for performing exercises. In some arrangements, the exercise device is structured to receive or hold a smart device, which can utilize an accelerometer to convert a user's movement as applied to the fitness device to actions in an application on the smart device. The exercised device as described herein provide improved stability and flexibility as compared to existing devices, and further provides layered connectivity between the exercise device and the user's smart device.

Referring now to FIGS. 1-8, various views of an exercise device 100 are shown, according to some arrangements. The exercise device 100 is configured to support a user's weight while the user performs exercises, as described herein. As shown in FIGS. 1-8, the exercise device 100 includes an upper base 110, a first wing 120, a second wing 130, a device holder 140, a pivot dome 150, and a lower base 160. The exercise device 100 (e.g., each of the components mentioned above) may substantially include generally rigid structures made of any suitable material or materials such as, but not limited to, metal, plastic, wood, composite materials, combinations thereof, or the like. The upper base 110 is structured to removably couple to each of the first wing 120 and the second wing 130, such that each of the first wing 120 or the second wing 130 can be separated from the upper base 110. In this way, each of the first wing 120 and second wing 130 can be manufactured and shipped in smaller components and assembled for use, and can be removed for cleaning or repair, or may be interchangeably swapped for other components in order to facilitate additional workouts or exercise moves (e.g., tension bands, handles, weighted bars, etc.)

When coupled together, the upper base 110, the first wing 120, and the second wing 130 form the device holder 140, which is structured, sized, and shaped to receive an electronic device (e.g., mobile phone, tablet, etc.). As shown, the upper base 110, the first wing 120, and the second wing 130 form a platform, which includes a recessed portion which is the device holder 140. In other words, the device holder 140 (e.g., the recessed portion) is formed out of walls, edges, indentations, or cut-outs in each of the upper base 110, the first wing 120, and the second wing 130 that form a crevice or pocket that is shaped and sized to receive the electronic device. The walls of the upper base 110, the first wing 120, and the second wing 130 define the walls of the device holder 140, which restricts the movement of the electronic device once the electronic device is deposited in the device holder 140. As shown in FIG. 1, the device holder 140 is substantially T-shaped to enable the electronic device to be held, relative to the upper base 110, in either a portrait mode (i.e., the larger dimension going up and down) or a landscape mode (i.e., the larger dimension going left and right). In other arrangements now shown, the device holder 140 may have another suitable shape, such as a square, a rectangle, an oval, a circle, and so on. The device holder 140 is further shown to include a plurality of projections 145 structured to provide grip and cushioning to the electronic device when held by the device holder 140. In some arrangements, the plurality of projections 145 are composed of a shock-absorbing and/or slip-resistant padding material, such as rubber or latex, which can prevent the electronic device from shifting within the device holder 140 or suffering damage due to abrupt movement of the exercise device 100. The projections 145 define a substantially flat surface on which the electronic device rests when the electronic device is received within the volume of the device holder 140. That is, the flat surfaces of the projections 145 are coplanar. In other arrangements for the device holder 140, a separate component that holds the electronic device and is coupled to the exercise device via a ball-in-socket joint or via any other type of coupling mechanism, including but not limited to a snap, a screw, a magnet, an adhesive.

A proximal portion of the device 100 (defined by portions of the upper base 110 as well as the first wing 120 and the second wing 130 oriented on opposite sides of the upper base 110) is adapted to receive the forearms of an exercising user. For example, the first wing 120 may be adapted to support a left arm of the user while the second wing 130 may be adapted to support a right arm of the user. In particular, when assembled, the proximal portion of the device 100 (including the portions (e.g., proximal ends) of the first wing 120 and the second wing 130 that are closer to the upper base 110, which is the part of the exercise device 100 closest to a user's torso when the user is using the device 100) may be wider or broader than the distal portion of the device 100 (defined by a distal ends of the first wing 120 and the second wing 130). In other words, when assembled, the device 100 tapers from the proximal portion to the distal portion. In some arrangements such as the one shown in FIG. 1, the first wing 120 includes a first texture 122 that is structured to provide grip and/or cushioning to a user. As such, the first texture 122 may be composed of a material different than the rest of the first wing 120 (i.e., a more slip-resistant or softer material, like rubber), or may include various gaps or comprise a particular pattern that creates a more slip-resistant surface for a user's arm while maintaining the same composition of the rest of the first wing 120. In some arrangements, such as the one shown in FIG. 1, the second wing 130 includes a second texture 132 that is structured to provide grip and/or cushioning to a user. As such, the second texture 132 may be composed of a material different than the rest of the second wing 130 (i.e., a more slip-resistant or softer material, like rubber), or may include various gaps or comprise a particular pattern that creates a more slip-resistant surface for a user's arm while maintaining the same composition of the rest of the second wing 130. In some examples, the first wing 120 and the second wing 130 are mirror images of one another.

The exercise device 100 further includes a first ridge 141 and a second ridge 142. As shown in FIG. 1, the first ridge 141 is part of and protrudes from the first wing 120 and the second ridge 142 is part of and protrudes from the second wing 130. The first ridge 141 and the second ridge 142 are located at the distal end of the exercise device 100 when assembled. As shown, the first ridge 141 is located on an end of the first wing 120 opposite to the end on which the first texture 122 is located, and the second ridge 142 is located on an end of the second wing 130 opposite to the end on which the second texture 132 is located. The first ridge 141 appears elevated with respect to the rest of the first wing 120. The second ridge 142 appears elevated with respect to the rest of the second wing 130. Each of the first ridge 141 and the second ridge 142 forms part of or defines the boundary of the device holder 140. The first ridge 141 and the second ridge 142 are structured as places upon which a user of the exercise device 100 may place their hands and grip the exercise device 100. As such, the first ridge 141 may include generally rigid structures made of any suitable material or materials such as, but not limited to, metal, plastic, wood, composite materials, combinations thereof, or the like. In some arrangements, the first ridge 141 may include a gripping portion 143 that provide support and friction for the grip while being more comfortable to the touch. The gripping portion 143 may be generally semi-rigid structures, such as foam, neoprene, memory foam, combinations thereof, or the like. As shown, the gripping portion 143 may include at least one protruding L-shaped stripes along the first ridge 141. Similarly, the second ridge 142 may include generally rigid structures made of any suitable material or materials such as, but not limited to, metal, plastic, wood, composite materials, combinations thereof, or the like. In some arrangements, the second ridge 142 may include a gripping portion 144 that provide support and friction for the grip while being more comfortable to the touch. The gripping portion 144 may be generally semi-rigid structures including without limitation foam, felt, polyethylene foams, or other suitable materials. As shown, the gripping portion 144 may include at least one protruding L-shaped stripes along the second ridge 142. In some examples, when doing the planking exercise, the user can put his or her left arms on the texture portion 122 while gripping the gripping portion 143 with his or her left hand, and the user can put his or her right arms on the texture portion 132 while gripping the gripping portion 144 with his or her right hand.

Figure 5:
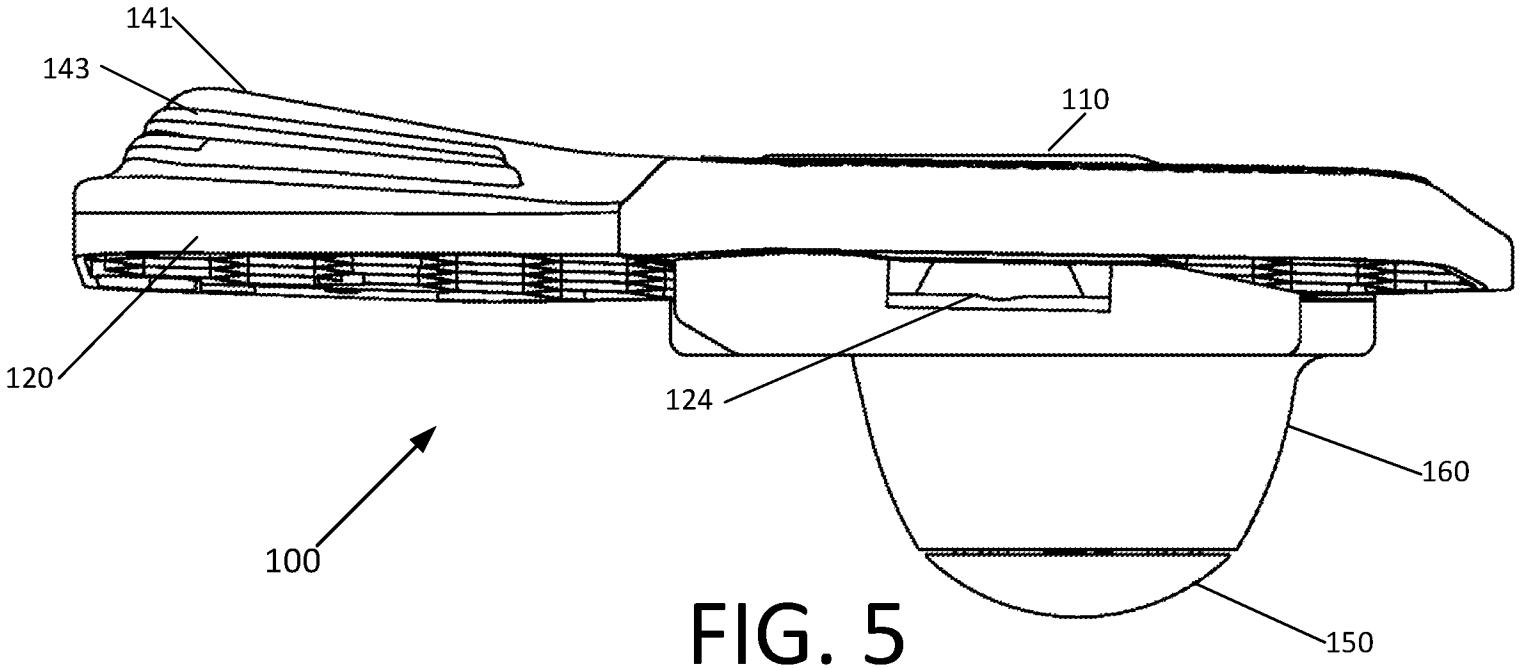
FIG. 5 is a second side view of the assembly of FIG. 1, according to some arrangements.
Figure 6:
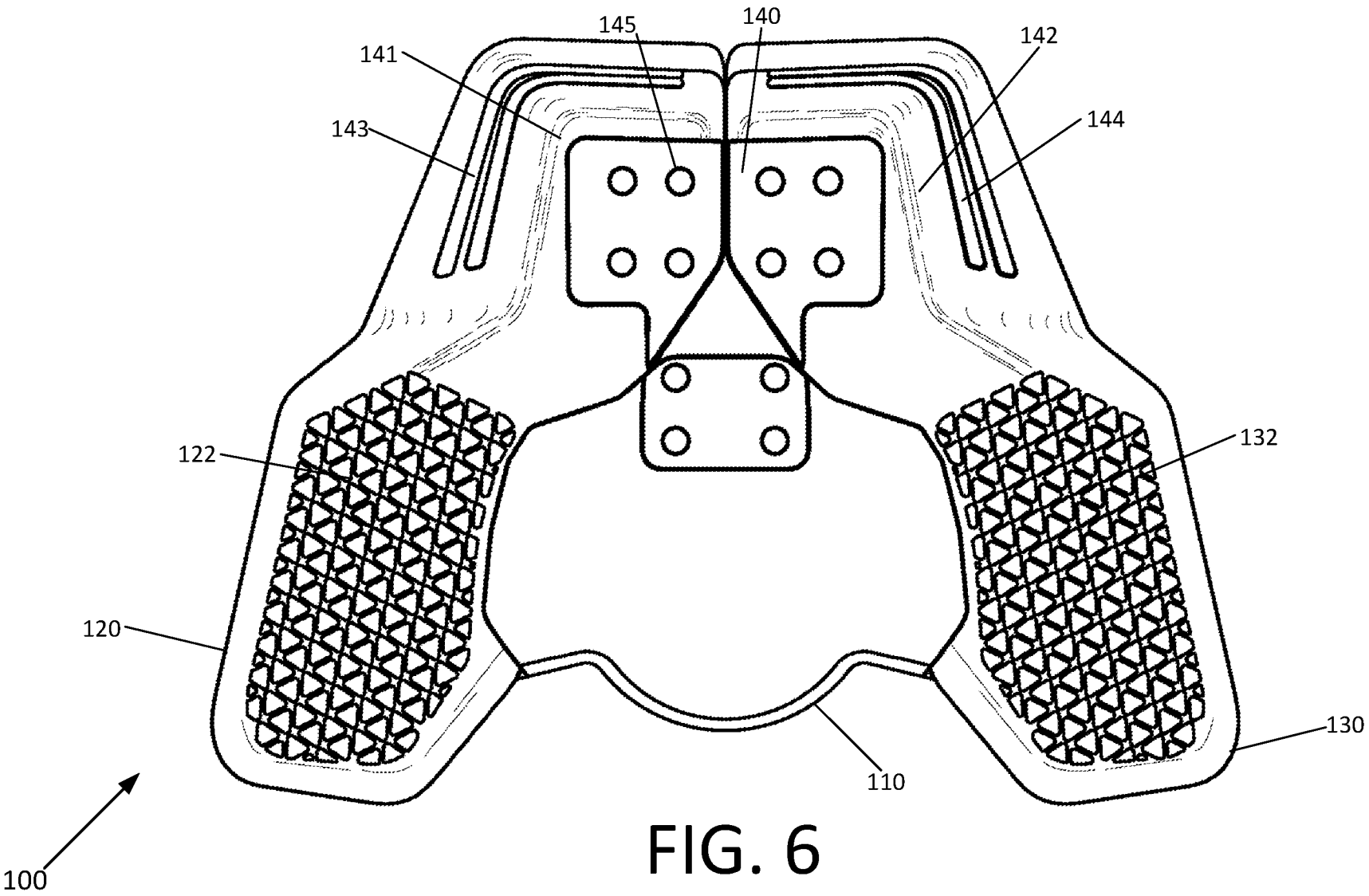
FIG. 6 is a top view of the assembly of FIG. 1, according to some arrangements.
Figure 7:
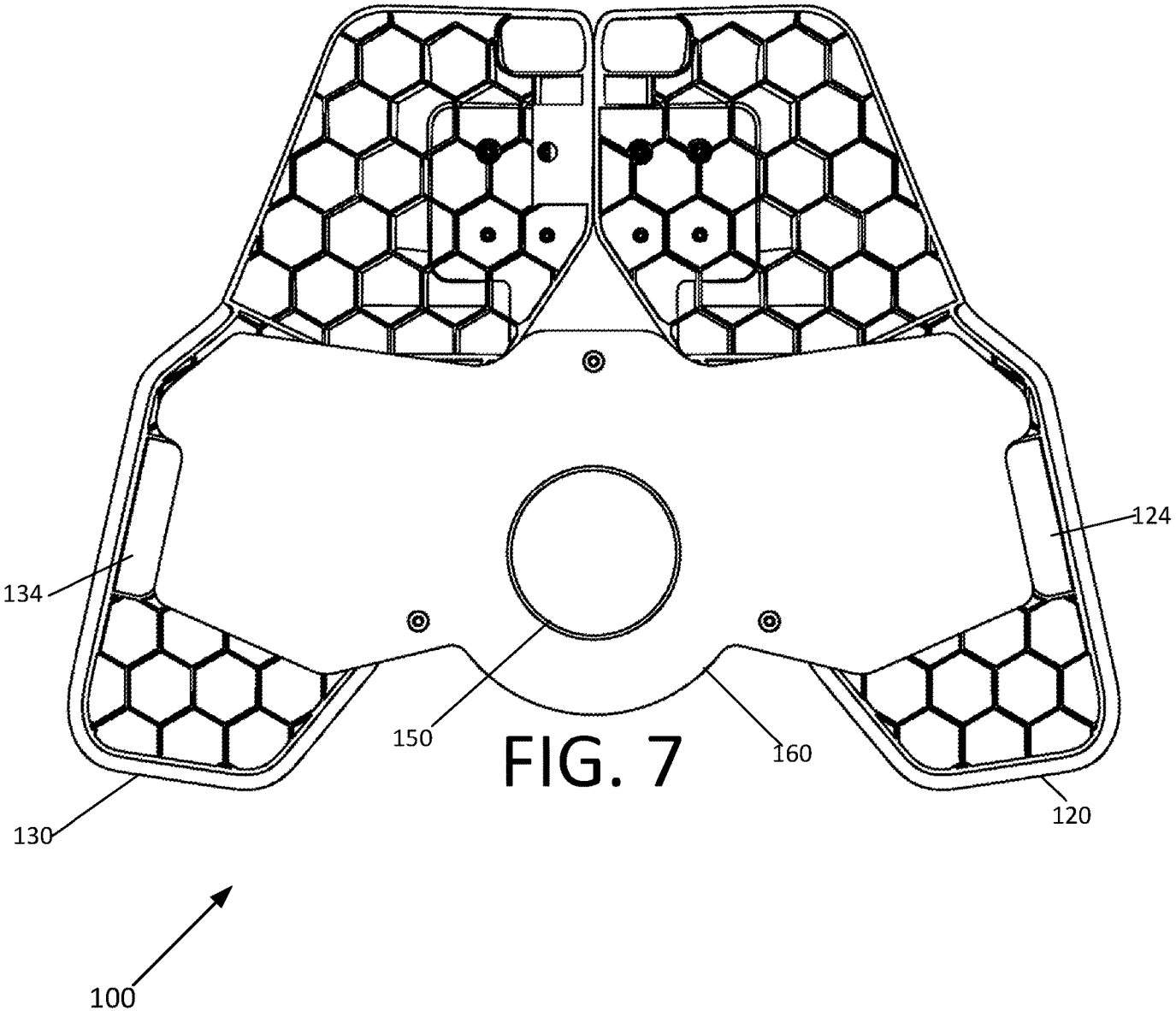
FIG. 7 is a bottom view of the assembly of FIG. 1, according to some arrangements.

The first wing 120, the second wing 130, and the upper base 110 can be removably coupled together. As shown in FIG. 5, the first wing 120 includes a first handle 124 that is structured for the user to grasp and apply force to in order to separate the first wing 120 from the rest of the exercise device 100. In some arrangements in which the exercise device 100 includes a locking mechanism (not shown) to keep the first wing 120 coupled to the upper base 110 (and/or coupled to the second wing 130 around the upper base 110), the first handle 124 may include a releasing mechanism to release or unlock the locking mechanism, thus allowing the first wing 120 to be separated from the exercise device 100.

Figure 4:
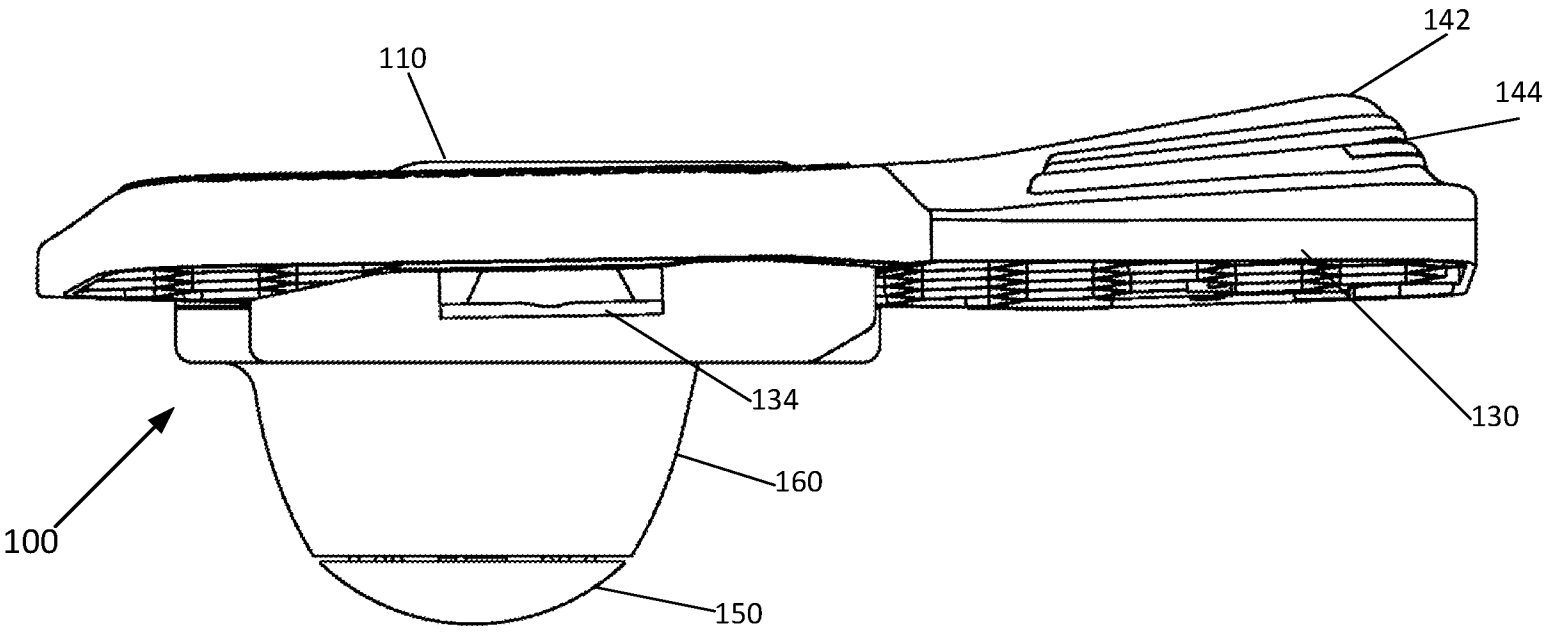
FIG. 4 is a first side view of the assembly of FIG. 1, according to some arrangements.

Similarly, as shown in FIG. 4, the second wing 130 includes a second handle 134 that is structured for the user to grasp and apply force to in order to separate the second wing 130 from the rest of exercise device 100. In some arrangements in which the exercise device 100 includes a locking mechanism (not shown) to keep the second wing 130 coupled to the upper base 110 (and/or coupled to the first wing 120 around the upper base 110), the second handle 134 may include a releasing mechanism to release or unlock the locking mechanism, thus allowing the second wing 130 to be separated from the exercise device 100.

Figure 2:
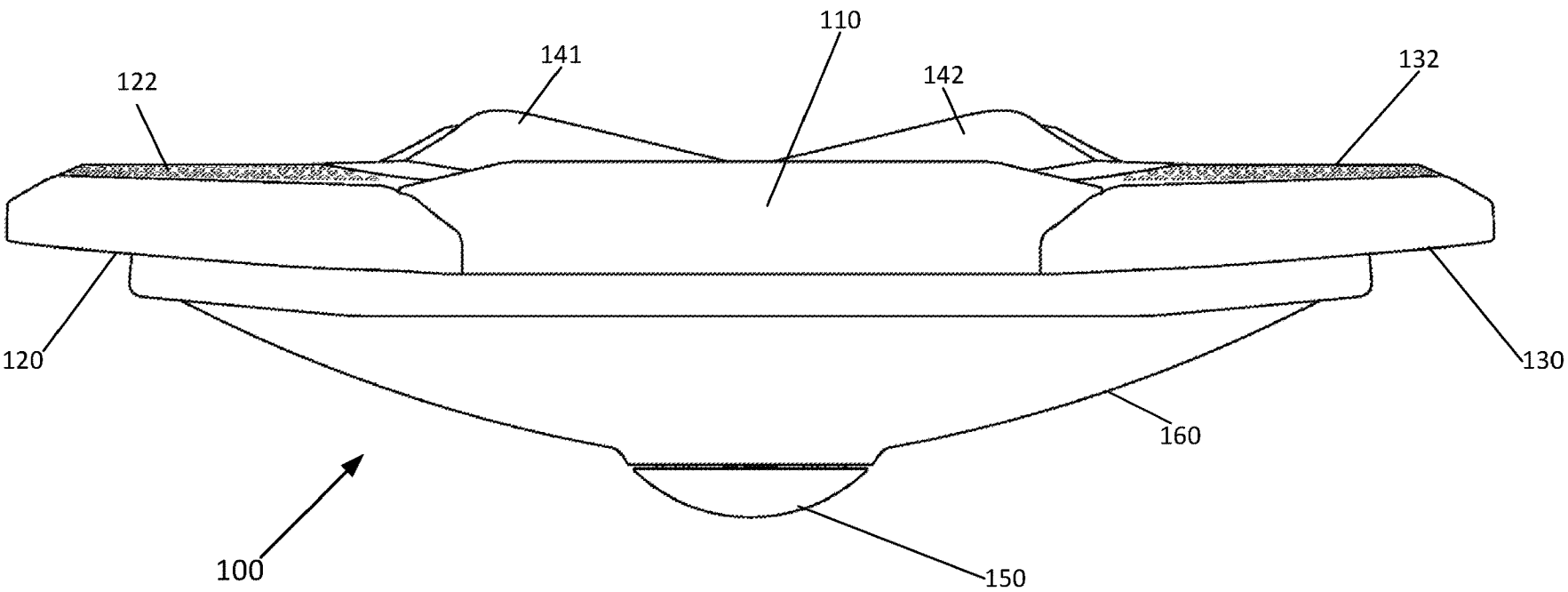
FIG. 2 is a rear view of the assembly of FIG. 1, according to some arrangements.
Figure 3:
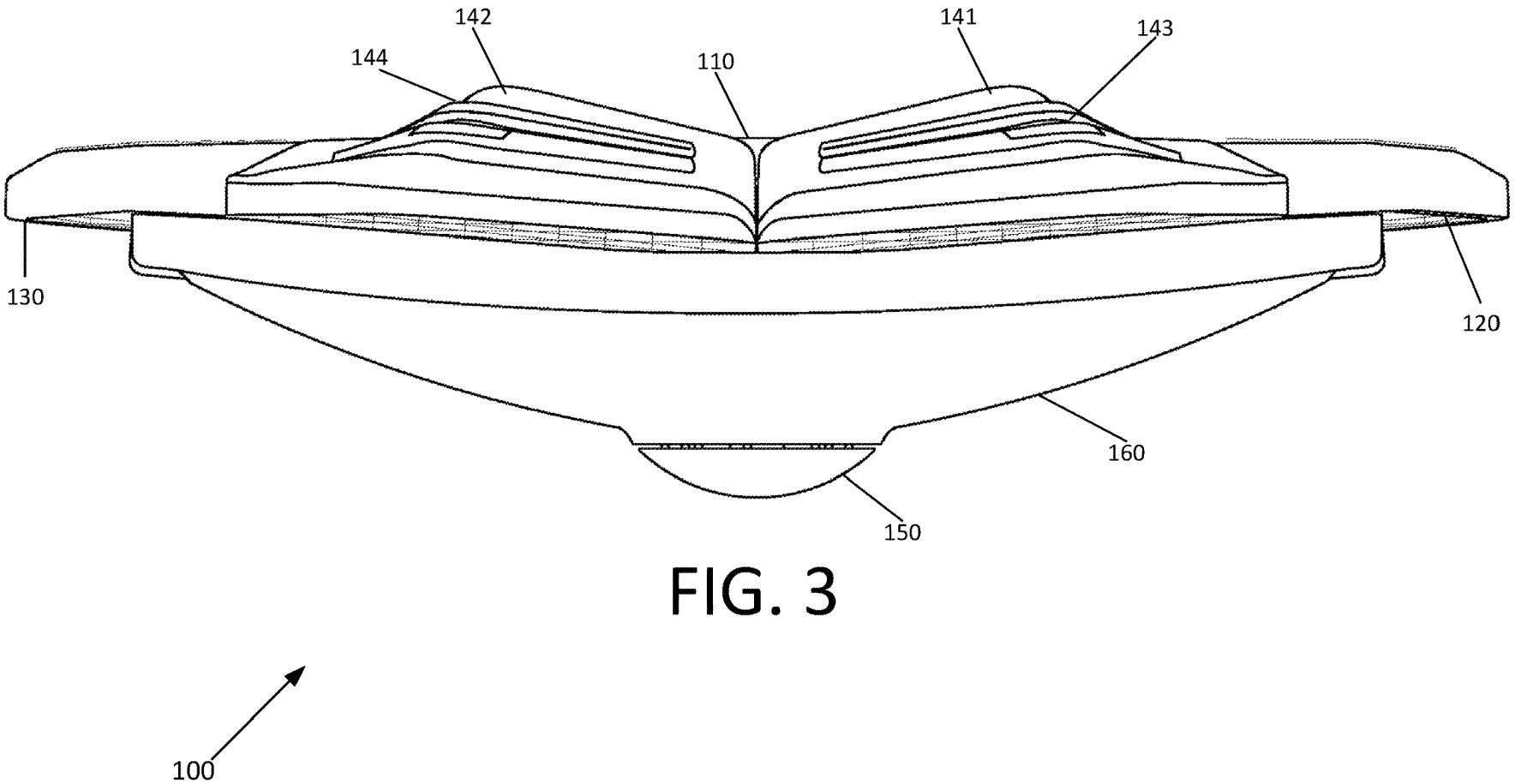
FIG. 3 is a front view of the assembly of FIG. 1, according to some arrangements.
Figure 9:
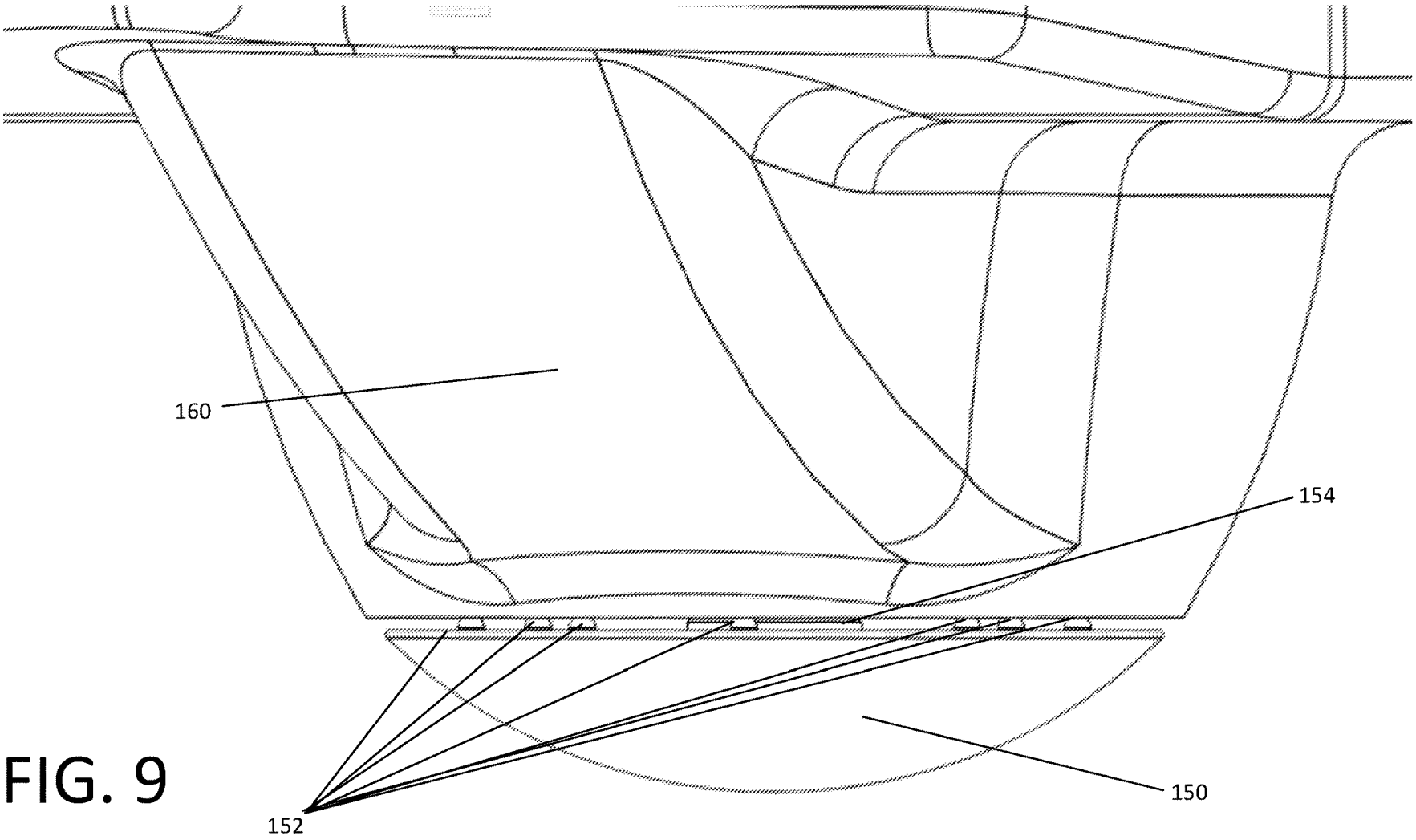
FIG. 9 is a perspective view of a pivot of the assembly of FIG. 1, according to some arrangements.

As shown in FIG. 2, the lower base 160 is positioned relatively under the location at which the upper base 110, the first wing 120, and the second wing 130 are removably coupled (e.g., attached, fixed, connected, or otherwise combined) and is structured to provide support to each of upper base 110, the first wing 120, and the second wing 130. Particularly when in use by a user for exercises, a large amount of weight (i.e., the user's entire body weight) is placed directly on the first wing 120 and the second wing 130. The lower base 160 supports this large amount of weight and transfers this weight to the pivot dome 150. The lower base 160 is also structured to be operatively coupled to the pivot dome 150 and related components, which are described in further detail below in relation to FIG. 9.

Figure 8:
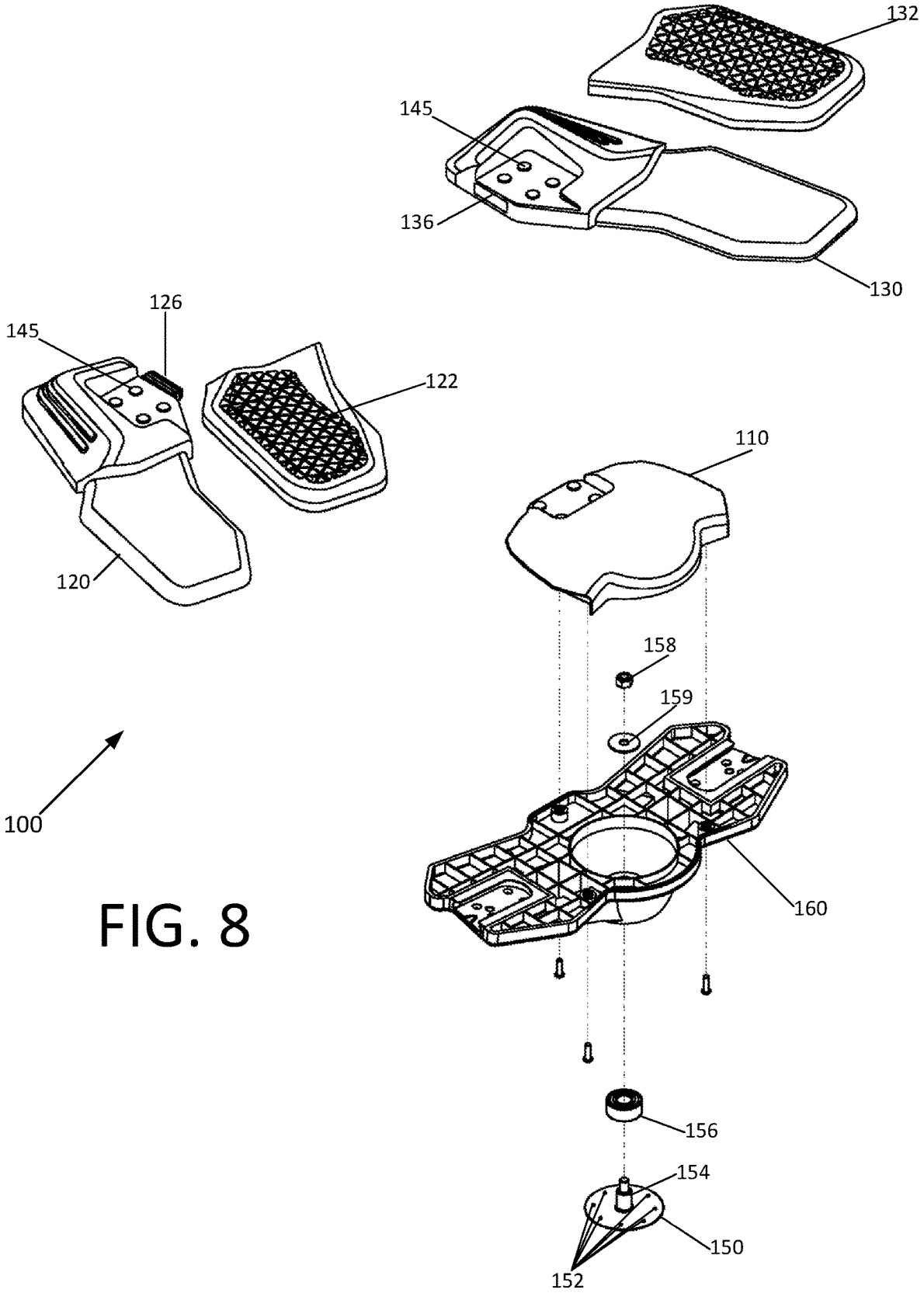
FIG. 8 is an exploded view of the assembly of FIG. 1, according to some arrangements.

Referring now to FIG. 8, the second wing 130 is further shown to include a receiving port 136, and the first wing 120 is further shown to include a coupling protrusion 126. As discussed herein, in some arrangements, the first wing 120 is structured to be operatively coupled to the second wing 130 directly (in addition to or rather than each of the first wing 120 and the second wing 130 coupling to the upper base 110). In such arrangements, the direct coupling may be performed by the coupling protrusion 126 sliding into and mating with the receiving port 136. The coupling protrusion 126, therefore, may include a ridge or larger end-piece, such that the coupling protrusion 126 resists removal from the receiving port 136. Alternatively, the coupling protrusion 126 may be beveled such that an end of the coupling protrusion 126 being inserted into the receiving port 136 is relatively small and tapers into a larger width towards a midpoint of the coupling protrusion 126. In this way, the coupling protrusion 126 slides into the receiving port 136 with minor resistance, but the larger width of the midpoint prevents sliding out of the receiving port 136. In these arrangements, the coupling protrusion 126 may include a release mechanism (not shown) that removes or releases the larger width of the midpoint and allows removal of the coupling protrusion 126 (and therefore removal of the second wing 130 from the first wing 120 and/or the exercise device as a whole). The receiving port 136 and the coupling protrusion 126 are examples of the mating mechanism between the first wing 120 and the second wing 130. Other types of mating mechanisms located at the distal ends of the first wing 120 and the second wing 130 that directly couples the first wing 120 and the second wing 130 can be likewise implemented.

As shown, a portion of the first wing 120 with the first texture 122 provided thereon may be separate from the rest of the first wing 120 and coupled to the rest of the first wing 120 via suitable attachment mechanisms such as glue, crews, snap fit, Velcro®, or another suitable mechanism. In other arrangements, first texture 122 is formed directly on the first wing 120. Similarly, a portion of the second wing 130 with the second texture 132 provided thereon may be separate from the rest of the second wing 130 and coupled to the rest of the second wing 130 via suitable attachment mechanisms such as glue, crews, snap fit, Velcro®, or another suitable mechanism. In other arrangements, second texture 132 is formed directly on the second wing 130.

As shown, the upper base 110 is operatively coupled to the lower base 160 via suitable attachment mechanisms such as screws. Other suitable attachment mechanisms can be suitable implemented. In some arrangements, each of the first wing 120 and the second wing 130 can be operatively coupled to the lower base 160 via suitable attachment mechanisms such as screws. Other suitable attachment mechanisms can be suitable implemented. In some arrangements, each of the first wing 120 and the second wing 130 may include additionally coupling mechanism (e.g., screws, glue, crews, snap fit, Velcro®, or another suitable mechanism) for attaching each of the first wing 120 and the second wing 130 to the upper base 110, to further secure the components of the device 100.

Referring now to FIGS. 1-9, a pivoting mechanism is shown to include the pivot dome 150 and related components are shown, according to some arrangements. The pivot dome 150 is substantially semi-spherical, with the flat surface positioned directly adjacent to and facing the lower base 160 when assembled, such that the curved face of the pivot dome 150 is oriented to face away from the exercise device 100 and face the support surface when assembled and used.

The pivot dome 150 is structurally coupled to the lower base 160 (and therefore the rest of the exercise device 100) via a shaft 154, which is configured to couple to a nut 158 through a buffer ring 156 and a washer 159. The shaft 154 is coupled to the lower base 160 in such a way that the shaft 154 is able to pivot around the coupling point (e.g., ball and socket joint, hinge, etc.). In this way, the end of the shaft 154 coupled to the lower base 160 (e.g., to the nut 158) is in a fixed position, and the end of the shaft coupled to the pivot dome 150 is able to move. In some arrangements, such as the one shown in FIG. 8, the buffer ring 156 of the lower base 160 is included about the shaft 154 to restrict movement of the shaft 154 and/or to provide a cushioning buffer between the shaft 154 and the lower base 160. Accordingly, the pivoting mechanism includes the pivot dome 150 and the shaft 154, the shaft 154 is pivotably coupled to the lower base 160 and fixed to the pivot dome 150.

In some arrangements, the shaft 154 may be spring-loaded, such that the shaft 154 includes a spring within the shaft 154 or is coupled to the lower base 160 via a spring. Because the shaft 154 is spring-loaded, the shaft 154 has a first length and a second length, with the first length (the spring being more stretched) being longer than the second length (the spring being more compressed) and with the spring constant of the spring of the shaft 154 causing the shaft 154 to be pre-disposed to the first length (without force being applied). The pivot dome 150 may have a first position (corresponding to the first length of the shaft 154) and a second position (corresponding to the second length). When in the pivot dome 150 is in the first position, the pivot dome 150 is positioned slightly away from the lower base 160 (such that there is space between the pivot dome 150 and the lower base 160 as shown). The pivot dome 150 and shaft 154 are able to move and pivot more freely in the first position. When the pivot dome 150 is in the second position, the flat surface of the pivot dome 150 is flush with and contacting the lower base 160, and movement of the pivot dome 150 is substantially restricted due to contact with the lower base 160. In some arrangements, a plurality of nubs 152 are fixed to the flat surface of the pivot dome 150. The plurality of nubs 152 are constructed of a non-slip material (e.g., rubber, latex) and provide strong frictional resistance to movement of the pivot dome 150 when the pivot dome 150 is in the second position, due to the plurality of nubs 152 interacting with the lower base 160.

In some arrangements, a user may place the exercise device 100 on the ground in order use the exercise device 100 to perform a modified push-up exercise. While the user is positioning the exercise device 100, the user is not bearing down on the exercise device 100, so the shaft 154 is not being compressed and the pivot dome 150 is in the first position. As such, the user is able to move the exercise device 100, in part, due to the pivoting motion of the pivot dome 150. However, once the user has positioned the exercise device 100 and is ready to perform exercises (e.g., the modified push-up), the user place their forearms on the first wing 120 and the second wing 130, and bears down on the exercise device 100 with their body weight, thus compressing the shaft 154 and moving the pivot dome 150 to the second position. In the second position, the pivot dome 150 is unable to move or pivot, so the exercise device 100 is substantially fixed in place and will not slip or slide while the user is exercising. This particular feature presents a substantial improvement over current exercise devices, which can slip while in use and injure or otherwise harm the user.

Furthermore, the user may then perform a push-up motion in order to target muscle development in the user's shoulders and chest, with the unstable support provided by the semi-spherical shape of the pivot dome 150 adding difficulty in comparison to the standard push-up. The user may also place an electronic device (e.g., smart phone) in the device holder 140, and the exercise device 100 is then able to utilize the accelerometer from the electronic device in order to play a game on the electronic device. In one such example, the game may be a driving simulator in which the steering controls are mapped to the exercise device 100. In this example, by twisting/rotating the exercise device 100 as one would twist/rotate a steering wheel, the user is able to play the driving simulator while exercising using the exercise device 100.

Any of the arrangements described may also include custom applications for the associated smart device. The applications guide the user through fun, interactive workouts. The applications will be calibrated and synchronized with the range of movement of the exercise device. The applications will also be able to be controlled by via another smart device so as a fitness trainer can send instructions to the users in real time using a separate smart device.

Any of the arrangements described may also function as a full-body controller for integrated or remote gaming. By leveraging an accelerometer of the mounted smart device (e.g., by the device holder 140), the exercise device 100 provides an immersive and intuitive gaming experience for a variety of applications. For example, the exercise device 100 could be used to play a car racing game by having the motion of the exercise device 100 serve as the steering controller for the car. The exercise device 100 can also function as a social media tool with which a user can perform a workout that is recorded visually with a graphical user interface and then sent to others as an invitation to attempt to complete the workout. Tilting of the exercise device 100 (as measured by the smart device) can control directional motion, speed, and other gaming aspects.

Figure 10:
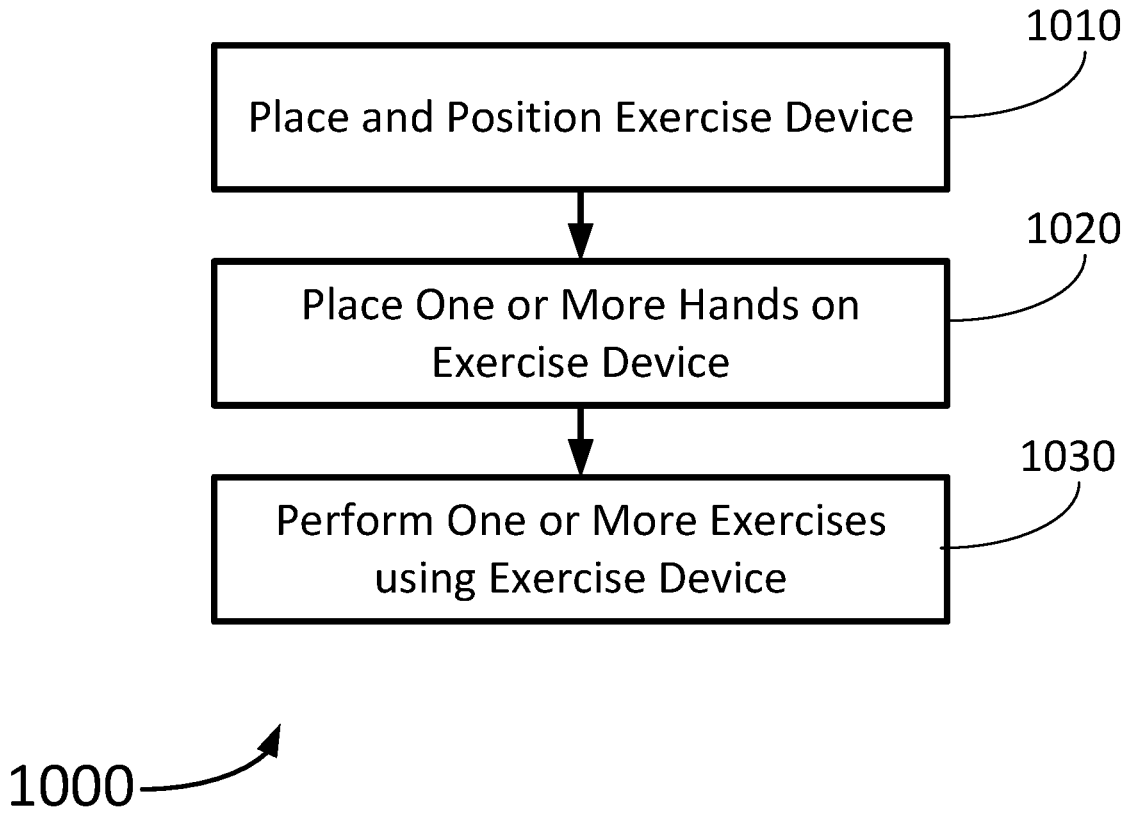
FIG. 10 is a flowchart illustrating steps for using an exercise device, according to some arrangements.

Referring now to FIG. 10, steps for a method 1000 of using an exercise device are shown. The method 1000 may be performed, in some arrangements, using the exercise device 100. As shown in FIG. 10, the method 1000 begins at step 1010, where a user places the exercise device 100 on the ground and positions the exercise device 100. At step 1020, the user places one or both hands (or forearms) on the wings of the exercise device 100, and, at step 1030, performs one or more exercises using the exercise device 100.

Figure 11:
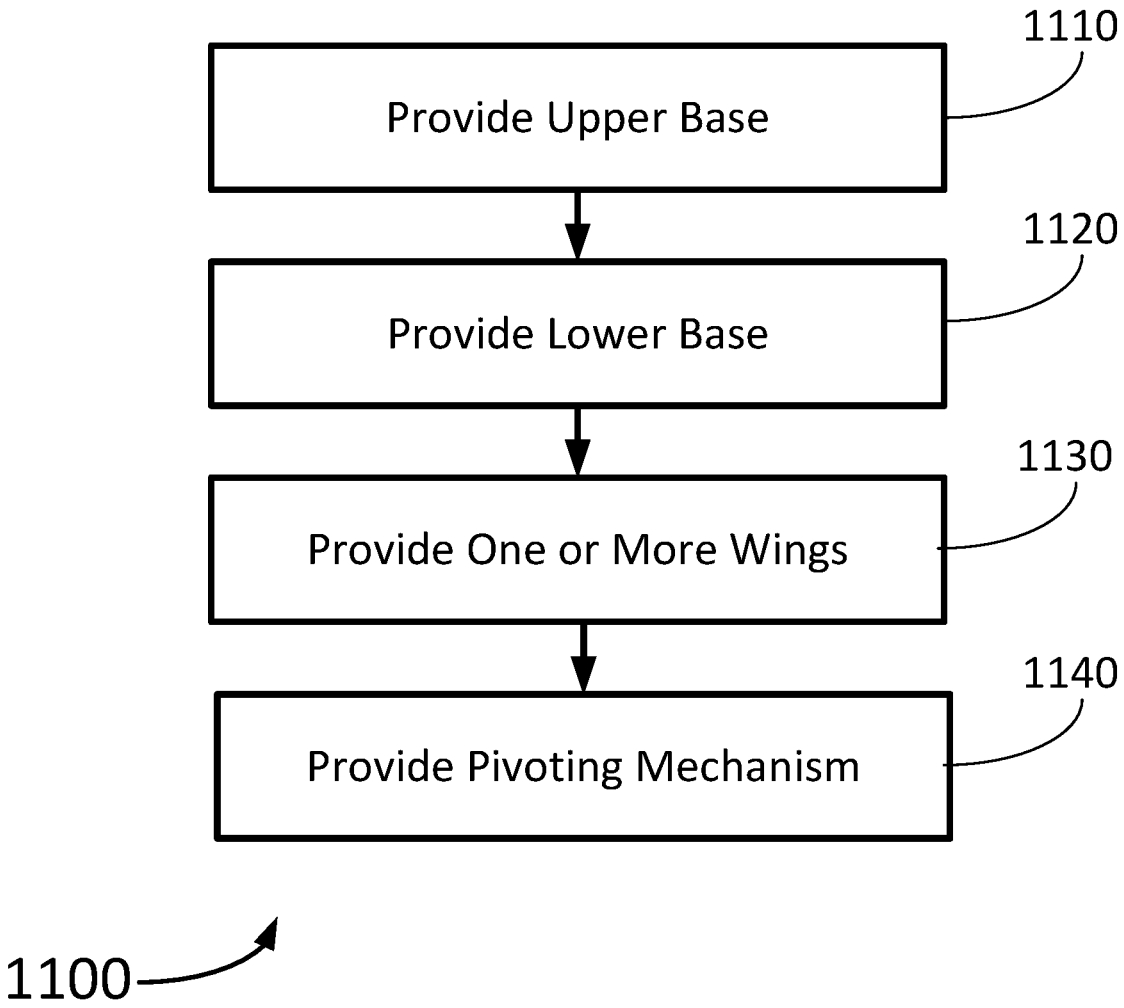
FIG. 11 is a flowchart illustrating steps for manufacturing an exercise device, according to some arrangements.

Referring now to FIG. 11, steps for a method 1100 of manufacturing an exercise device are shown. In some arrangements, the exercise device is the exercise device 100 described herein. As shown in FIG. 11, the method 1100 begins at step 1110, where a manufacturer provides an upper base for the exercise device. In some arrangements, the upper base is the upper base 110. At step 1120, the manufacturer provides a lower base portion for the exercise device and fixes the lower base portion to the upper base portion. In some arrangements, the lower base portion is the lower base 160. At step 1130, the manufacturer provides one or more wings that are coupled to each other. In some arrangements, the one or more wings include the first wing 120 and the second wing 130. At step 1140, the manufacturer provides a pivoting mechanism and couples the pivot mechanism to the exercise device. In some arrangements, the pivoting mechanism is the pivot dome 150, the plurality of nubs 152, and the shaft 154.

Figure 12:
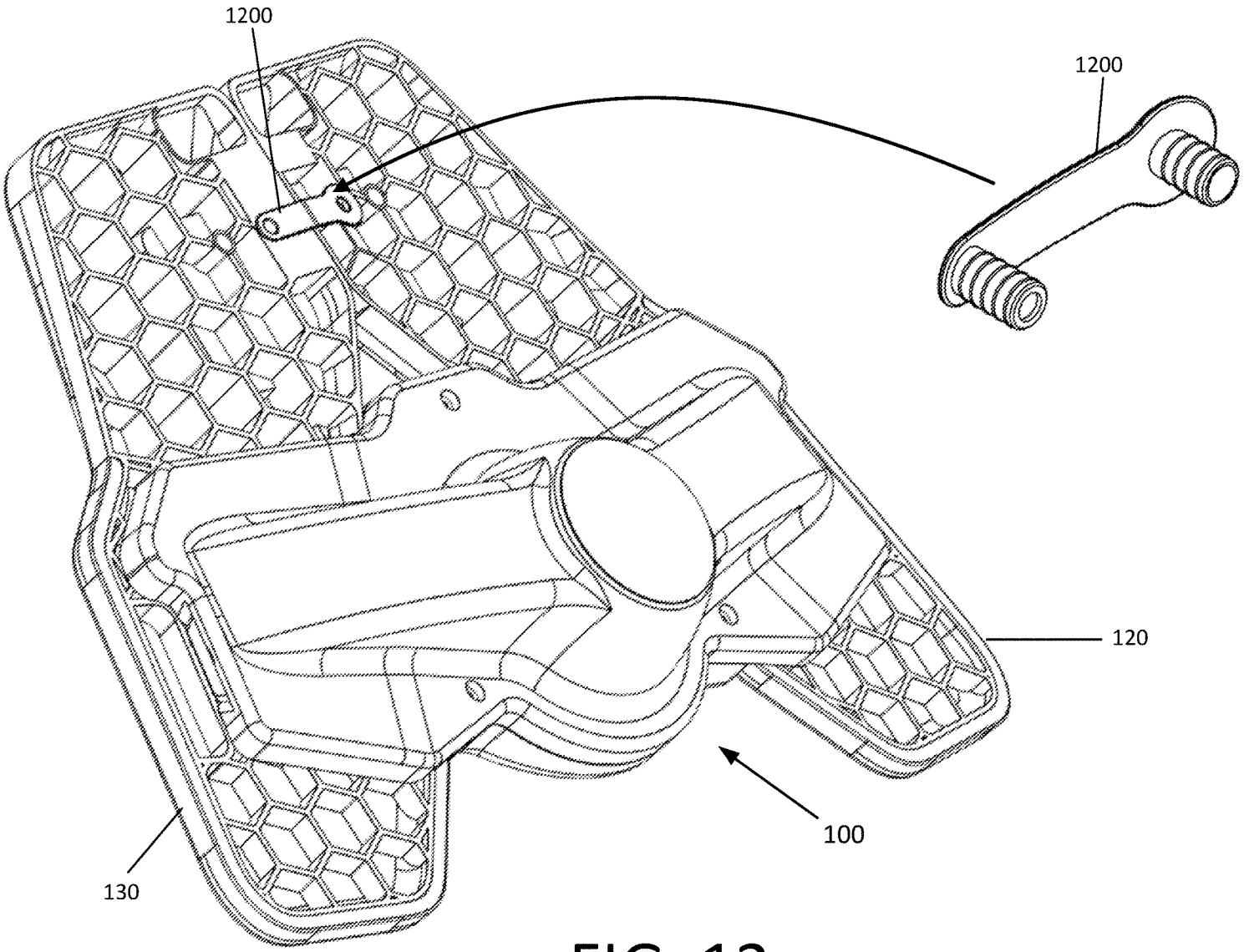
FIG. 12 is a perspective view of the assembly of FIG. 1, according to some arrangements.

Referring to FIG. 12, the exercise device 100 can include an engagement mechanism (e.g., a safety clip 1200) that can secure the first wing 120 and the second wing 130 together. For example, when the first wing 120 and the second wing 130 are coupled to one another as shown (e.g., brought side-by-side adjacent to one another to form the platform), the user can secure the first wing 120 and the second wing 130 in place by engaging the safety clip 1200 to both the first wing 120 and the second wing 130. As shown, the safety clip 1200 includes two cylindrical protrusions, one for inserting into a hole on the bottom side of the first wing 120 and another one for inserting into a hole on the bottom side of the second wing 130. When both protrusions are received by the holes in the first wing 120 and the second wing 130, the first wing 120 and the second wing 130 are further secured in place by the safety clip 1200, thus preventing the first wing 120 and the second wing 130 from disengaging from one another when the exercise device 100 is under rigorous use by the user. The safety clip 1200 is an example of additional mechanism for securing the first wing 120 and the second wing 130 together, and other fasteners (e.g., latches, pins, nails, clips, locks, and so on) can be likewise implemented. Such mechanism can be located on the bottom side of the exercise device 100 to avoid interfering with the user's exercise.

As discussed herein, the exercise device 100 provides a safer and more effective workout experience through the dynamic pivot dome 150, which enables relatively free movement when the user's weight is lifted from the exercise device 100 and then provides a secure base when the user bears down. The exercise device 100 also provides an increased degree of customization and flexibility via the removably coupled wings (i.e., the first wing 120 and the second wing 130), which can be free removed or replaced to allow for cleaning or repair or for replacement by an alternate attachment (e.g., tension band, handle, etc.). Furthermore, by being adapted to receive a smart phone (or other smart device), the exercise device 100 works in tandem with an accelerometer of the smart phone in order to provide inputs to a mobile phone application. This application may be a dedicated game that maps the movement of the exercise device 100 to movement within the game, such that pivoting the exercise device 100, in one example, turns a steering wheel for a vehicle within the game. Through such direct interactivity in combination with the attachments, the exercise device 100 provides an enhanced user experience.

The foregoing description of arrangements has been presented for purposes of illustration and description. It is not intended to be exhaustive or to limit the disclosure to the precise form disclosed, and modifications and variations are possible in light of the above teachings or may be acquired from this disclosure. The arrangements were chosen and described in order to explain the principals of the disclosure and its practical application to enable one skilled in the art to utilize the various arrangements and with various modifications as are suited to the particular use contemplated. Other substitutions, modifications, changes and omissions may be made in the design, operating conditions and arrangement of the arrangements without departing from the scope of the present disclosure as expressed in the appended claims.

The above used terms, including "attached," "connected," "secured," and the like are used interchangeably. In addition, while certain arrangements have been described to include a first element as being "coupled" (or "attached," "connected," "fastened," etc.) to a second element, the first element may be directly coupled to the second element or may be indirectly coupled to the second element via a third element.

What is claimed is:

1. An exercise device comprising:

an upper base;

a lower base;

two wings; and a pivoting mechanism, wherein the upper base and the two wings form a device holder being shaped and sized to receive an electronic device, wherein the pivoting mechanism comprises a pivot dome and a shaft, the shaft pivotably coupled to the lower base and fixed to the pivot dome, and wherein the shaft has a first length and a second length, the shaft is configured to alter its length from the first length to the second length based on application of pressure, and the first length being longer than the second length.

2. The device of claim 1, wherein the shaft further comprises a spring that causes the shaft to be pre-disposed to the first length, and the pivot dome comprises a first position corresponding to the first length and a second position corresponding to the second length.

3. The device of claim 2, wherein movement of the pivot dome is restricted in the second position.

4. The device of claim 2, wherein the pivot dome further comprises a plurality of nubs, the plurality of nubs comprising a non-slip material.

5. The device of claim 2, wherein the pivoting mechanism further comprises a buffer ring positioned substantially around the shaft, the buffer ring structured to restrict movement of the shaft.

6. The device of claim 1, wherein the shaft is coupled to the lower base via a ball-and-socket coupling.

7. An exercise device comprising:

an upper base;

a lower base;

two wings, wherein the two wings comprise a first wing and a second wing, the first wing structured to be removably coupled to the second wing;

an engagement mechanism to secure the first wing and the second wing together; and a pivoting mechanism, wherein the upper base and the two wings form a device holder being shaped and sized to receive an electronic device.

8. The device of claim 7, wherein the first wing further comprises a first ridge and wherein the second wing further comprises a second ridge.

9. The device of claim 8, wherein the first ridge comprises a first gripping portion, and the second ridge comprises a second gripping portion.

10. The device of claim 7, wherein the two wings are removably coupled to each other.

11. The device of claim 7, wherein each of the first wing and the second wing comprise a texture portion.

12. The device of claim 7, wherein the device holder is T-shaped in order to receive the electronic device in a landscape orientation and in a portrait orientation.

13. The device of claim 7, wherein the device holder further comprises a plurality of projections, the plurality of projections comprising at least one of a non-slip material or a cushioning material.

* * * * *